US009837057B1

(12) United States Patent
Jespersen

(10) Patent No.: US 9,837,057 B1
(45) Date of Patent: Dec. 5, 2017

(54) TELESCOPING, INTERCHANGEABLE, DRUMSTICK/SHAKER

(71) Applicant: Jaime Broce Jespersen, Midway, UT (US)

(72) Inventor: Jaime Broce Jespersen, Midway, UT (US)

( * ) Notice: Subject to any disclaimer, the term of this patent is extended or adjusted under 35 U.S.C. 154(b) by 0 days.

(21) Appl. No.: 15/268,053

(22) Filed: Sep. 16, 2016

Related U.S. Application Data

(60) Provisional application No. 62/284,029, filed on Sep. 18, 2015.

(51) Int. Cl.
*G10D 13/02* (2006.01)
*G10D 13/00* (2006.01)
*G10D 13/06* (2006.01)

(52) U.S. Cl.
CPC ..... *G10D 13/003* (2013.01); *G10D 13/06* (2013.01)

(58) Field of Classification Search
USPC ..... 84/402
See application file for complete search history.

(56) References Cited

U.S. PATENT DOCUMENTS 2,466,554 A 4/1949 Mossey
2,485,824 A 10/1949 Gladstone
3,150,555 A * 9/1964 Sage ..... G10D 13/003 84/422.4
4,200,026 A 4/1980 Phreaner
4,535,671 A 8/1985 Stromberg et al.
4,570,527 A 2/1986 Pruitt
4,970,934 A * 11/1990 Reed ..... G10D 13/003 84/422.4
5,265,514 A * 11/1993 Schertz ..... G10D 13/003 446/419
6,002,077 A 12/1999 Nicolosi
8,674,204 B2 3/2014 Rundle
2008/0168889 A1 7/2008 Rundle
2012/0144975 A1* 6/2012 Destocki ..... G10D 13/003 84/402
2015/0170620 A1* 6/2015 Rundle ..... G10D 13/003 84/422.4

* cited by examiner

*Primary Examiner* — Christopher Uhlir

(57) ABSTRACT

This drumstick is a telescoping, interchangeable, drumstick/shaker; it includes a hollow tube body with removable shaft screw collars on each end; it has smaller tube shaker cartridges with a smaller circumference than the inner tube which allows the user to combine the drumstick with a maraca like sound if they so please. There is also another smaller tube that is attached to the small tail end portion, directly around the different drumstick types that allows the drumsticks to telescope through the entire length of the larger tubes inner circumference which can be used for dispensing, storage, and playing. This allows the end user to freely configure it to his or her own will.

14 Claims, 2 Drawing Sheets

TELESCOPING, INTERCHANGEABLE, DRUMSTICK/SHAKER

BACKGROUND OF INVENTION

1. Field of Invention

This invention relates to percussion instruments; more particularly, it is a telescoping, interchangeable, drumstick/shaker. Technical field 84/422.4.

2. Background Art

There are three categories for drumsticks—the stick type, the brush type, and rod type The traditional solid wooden drumstick ranges from about 15" to 18" in length and includes butt, shaft, and tip portions. One of the ends typically was in the shape of a ball-like head which was used to beat on the drum to create a large sound.

The drum brush type drumsticks were usually made up of a plurality of metal filaments, secured to a handle to create a soft swishing sound. Examples include U.S. Pat. No. 4,200,026, U.S. Pat. No. 2,485,824.

The rod type drumstick are usually made from round hardwood rods such as dowels that are banded together to form a stick that can produce a sound between that of the solid stick type and a brush. Examples include U.S. Pat. No. 4,535,671, U.S. Pat. No. 4,570,527 U.S. Pat. No. 6,002,077

Various suggestions have been made to add the rattle type sound of a maraca to a traditional wood drumstick for example, U.S. Pat. No. 2,466,554 a discloses conventional wooden drumstick that is inserted through a maraca gourd so that the maraca gourd is, in effect, a part of the drumstick creating a rattle sound.

U.S. Pat. No. 5,265,514 is an improved drumstick that is provided for producing a rattling maraca type sound as the drumstick is used by the drummer. The drumstick includes a tip section for striking the drum, a handle section which is used to grip the drumstick, and an intermediate connecting section that joins the tip and handle sections together and forms a complete drumstick. The intermediate connecting section includes a hollow cavity in which a number of pellets are loosely received creating a rattling sound when stuck.

Combination drumsticks have also been attempted where trying to combine the traditional wood shaft of a drumstick to rod type or brush drumstick. Examples include U.S. Pat. No. 8,674,204 The traditional drum stick handle is lathed to a specified shape that includes in its shape, a pod with a widen bulb area, at the perpendicular horizontal end of the pod, a hole is drilled to hold the multiple rods which are inserted and glued into the hole creating a unique multi task drum stick.

U.S Pat No. 2008/0168889 A stick type drumstick is disclosed comprised of a solid wood shaft, herein after referred to as the shaft. The shaft extends to a position where a hole is drilled in the horizontal plain starting at the end nearest to the striking or beating end. Further, the stick type drumstick includes a head consisting of a plurality of individual rods formed around a foam core, this combination of individual rods and foam core combination of the center foam core and the individual rods combine to create a distinct and unique percussive sound.

With respect to the inventions listed above, taken either singly or in combination is capable of producing a well balanced, interchangeable drumstick capable of multiple and triple types of drumstick and shaker combination while allowing the user to freely configure it. Also another reason for this invention is only a small end or tapered portion of the drum stick is actually being utilized for striking the drum, therefore the impact causes the end of the drumsticks to break frequently, leaving the handle (shaft) used for gripping the drumstick undamaged, creating wasted material. For the foregoing reasons, this telescoping drumstick was created using the following methods.

SUMMARY OF THE INVENTION

The objective of this invention is to provide a well balanced, interchangeable, telescoping drumstick, capable of multiple types of drumstick/shaker configurations that are not confined to a specific embodiment, allowing the user to freely configure it to his or her own liking.

This is achieved by having a hollow tube body with removable shaft screw collars on each end. It includes tube shaker cartridges and drumstick tube cartridges that are attached to the small tail end portion of the different drumstick types noted above. These tube cartridges have a smaller outer circumference than the hollow tube body's inner circumference, which allows these tube cartridges to telescope through the hollow tube body. The hollow tube body is from thin wall carbon fiber tubing or 6061 aluminum; its high strength, light weight, and its composition provides protection for the drumsticks and/or shaker being stored within the hollow body. The light weight of the hollow tube body: makes it perfect for storing replacement drumsticks inside the hollow tube body, allowing it to mimic or match each other in weight, thus providing a well balanced drumstick. Also, utilizing the hollow tube body as the gripping area and utilizing only a small portion of the different drumstick types creates less waste, thus creating more eco-friendly drumstick.

The shaft screw collar locks and unlocks the hollow tube body and inner tube cartridges together and can be installed singly or on both ends of the hollow tube body. This gives the user the ability to freely configure the device to create multiple types of drumstick/shaker configurations without being confined to the hollow tube body.

DETAILED DESCRIPTIONS OF THE INVENTION

Telescoping, interchangeable, drumstick/shaker.

Figure 1:
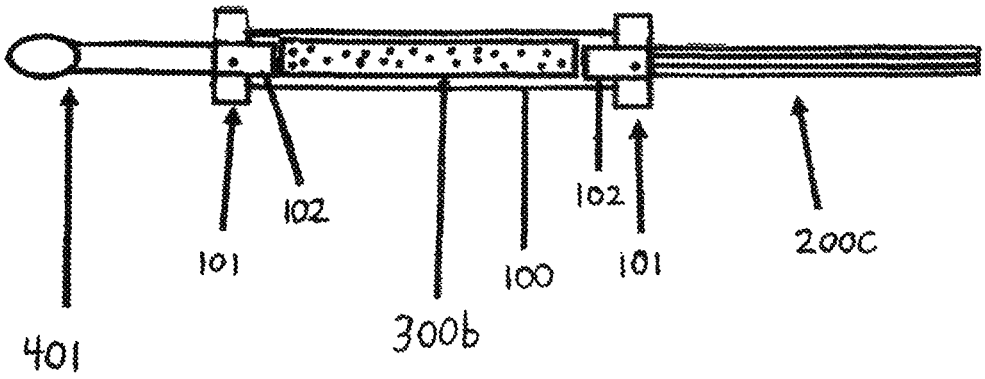
FIG. 1 shows a drumstick having different end configurations combined with a shaker.

FIG. 1: Illustrates the embodiment of a telescoping, interchangeable, drumstick/shaker. 100 is the hollow tube body/gripping area made from carbon fiber or aluminum tubing. In this embodiment 100 the hollow tube body is storing shaker tube cartridge 300*b*. The shaker tube cartridges have a smaller outer circumference than the hollow tubes body's inner circumference which allows the shaker tube cartridges to telescope into the 100 hollow tube body. 101 is the shaft screw collar, made from clear polycarbonate tubing, carbon fiber tubing, or aluminum tubing; this component is used for releasing, storing, and locking the drumstick tube cartridges and shaker tube cartridges into place. 102 is the drumstick tube cartridge, made from brass or aluminum tubing, it is attached to the different drumsticks types and is not limited to any type of drumstick used for striking a drum or a percussion device. They have a smaller outer circumference than the hollow tubes body's inner circumference which allows these drumstick tube cartridges to telescope into the 100 hollow tube body. In this embodiment 101 shaft screw collars have been installed on both ends of 100 hollow tube body and have locked the drumstick tube cartridges, configuration 201*b* multi rod and drumstick configuration 401 for playing of this device.

This particular embodiment depicts how two different drumstick types can be used to create two different tones when struck while also combining a shaker maraca like sound.

Figure 2:
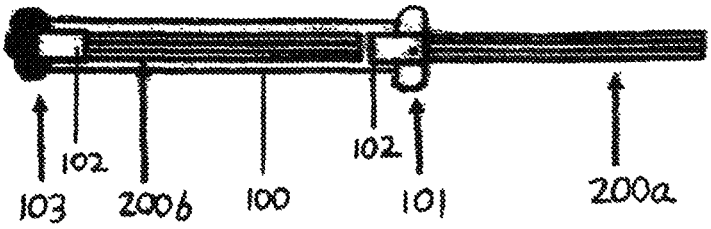
FIG. 2 shows a drumstick having a multirod configuration with storage capacity.

FIG. 2: Illustrates the embodiment of a telescoping, interchangeable, drumstick/shaker. This embodiment depicts multi rod drumstick 200*b*, it is stored in FIG. 100 hollow tube body, and while multi rod 200*a* is locked into place by FIG. 101 for playing. 103 is the vinyl end cap. This embodiment depicts how this device can store an identical replacement drumstick tube cartridge inside of its hollow tube body; this is identical to the drumstick tube cartridge type that has been locked down by the shaft screw collar for playing of this device. Once the drumstick tube cartridge needs to be replaced, the user would unlock the drum stick tube cartridge via shaft screw collar and telescope the replacement drumstick into its place.

Figure 3:
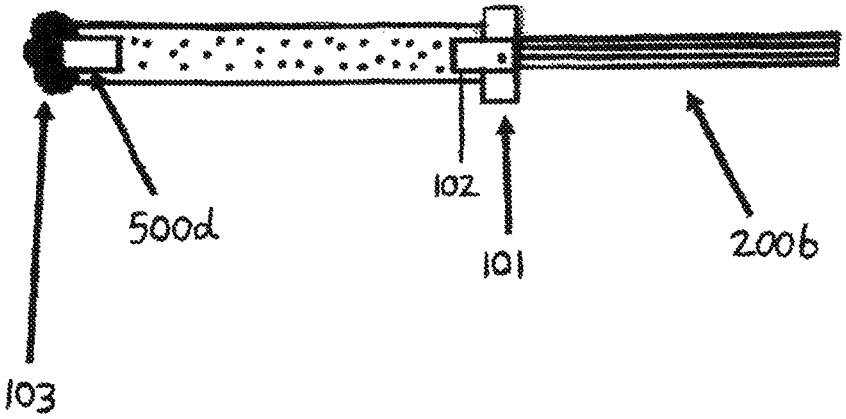
FIG. 3 shows a drumstick having a multirod configuration with a shaker body.
Figure 4:
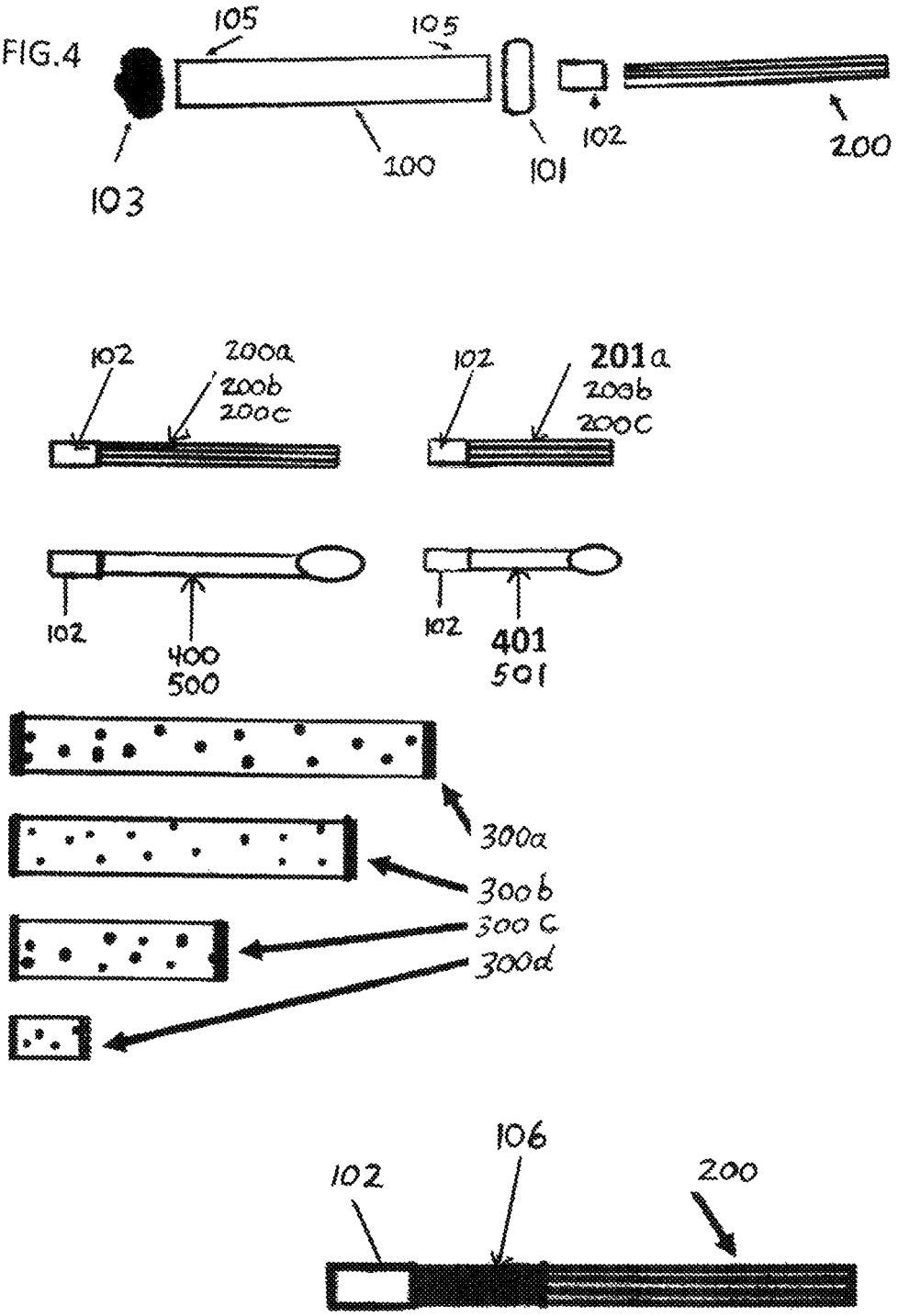
FIG. 4 shows various interchangeable components of the drumstick.

FIG. 3: Illustrates another embodiment of a telescoping, interchangeable, drumstick/shaker. This embodiment depicts how the 500*d* hollow tube body shaker cartridge can be combined with a 200*b* multi rod drumstick to produce multiple sounds. In this embodiment 500*d*, shaker tube cartridge; releases beads into FIG. 100 hollow tube body. 101, the shaft screw collar, has locked multi rod drumstick configuration 200B for playing. 103 is the vinyl end cap.

This embodiment depicts how the hollow body can be transformed into a shaker by releasing the beads held in the 500*d* hollow tube body shaker cartridge into the hollow tube body caped off with 103 vinyl end cap. This produces a louder shaker like maraca sound adding another dimension to this device.

SPECIFICATION

Step 1:
Hollow Tube Body
Materials:
OD 0.625 in×ID 0.555 in (drawings 100) thin wall carbon fiber tubing or aluminum tubing.

These materials are chosen for their high strength, light weight, and thin wall.

Procedure: Cut hollow tube body to 8¾ in length. Using miter saw, pipe cutter, or any saw capable of cutting carbon fiber or aluminum tubing. After making the cut, the hollow tube body will be deburred and sanded ½ up from bottom of the hollow tube body to allow shaft screw collars to be fitted and installed to the hollow tube body. The hollow tube body may be painted to any color or design.

Step 2: (Drawings 105) Drill 3/16 in Hole in Hollow Tube Body.

Procedure: At ¼ inch from the bottom at both ends of the hollow tube body, mark and drill a 3/16 in hole ¼ in on center using a drill or drill press. This is in preparation for the installation of a set screw shaft collar as seen in step 3.

Step 3: Installation Shaft Screw Collar
Materials:
OD 0.875 in×ID 0.625 in LN 0.5 in (drawings 101) the shaft screw collar is made from clear polycarbonate tubing, carbon fiber tubing or aluminum tubing with #10-32×3/16 in Allen Wrench, cup point set screw
—Allen Wrench Procedure: The Allen Wrench cup set screw is located in the shaft screw collar. When tightened, it will lock the tube cartridge holding the drumsticks, multi rods, into place for playing. When released, it will allow for removability of the drumstick tube cartridge.

The clear polycarbonate composition of the shaft collar was chosen for its high strength and durability. Since the polycarbonate is clear, it allows for visibility to line the set screw with the 3/16 inch hole that was drilled in the hollow tube body in step 2. The set screw shaft collar is a key component that works in conjunction with all components of this device for storage, dispensing, reloading, and playing of this device. Slide shaft screw collar over the hollow tube body. Align the 3/16 in set screw in the shaft collar with the 3/16 in hole that was drilled in the hollow tube body.

Note: The shaft screw collar can be installed on both ends of the hollow tube body or at one single end depending on the users' preference.

Step 4: Cutting Drumstick Tube Cartridge to Length
Material:
OD 0.53125 in×ID 0.50325 in brass tubing, aluminum tubing, or carbon fiber tubing.

Procedure: Cut drumstick tube cartridge to ½-1 in length. Using miter saw, pipe cutter, or any saw capable of cutting carbon fiber or aluminum tubing. After making the cut, the tube will be deburred using sand paper, steel wool, or reamer.

Step 5:
The following different lengths will offer the user multiple configurations for storage, dispensing, and playing of this device.
Materials:
Drums stick, mallet, brush drumstick shaft OD ½ in
Multi rods solid wood OD ⅛ in and OD 3/16 in Procedure: cut to 8¼ in length and 3⅝ in length using a miter saw or any wood cutting saw.

Step 6: Conjoining the Drumstick and Multiple Multi Rods Configurations, Along with the Drumstick Tube Cartridge and Shrink Tube.
Materials:
—Glue
Drumstick tube cartridge OD 0.53125 in ID 0.50325 in LN 0.5 to 1 in
(Configuration drumstick 400,401), (Configuration mallet drumstick shaft 500,501) shaft, OD 0.5×LN 8¼ in and OD 0.5 in×LN 3⅝ in
Heat shrink tube OD ½ in LN 4 in
(Configuration 200*a*, 201*a*) Multi rods 12, OD ⅛ in×LN 8¼ in and 12, OD ⅛ in×LN 3⅝ in for each drumstick tube cartridge
(Configuration 200*b*,201*b*) Multi rods 5, OD 3/16 in×8¼ in and 1, OD ⅛ in×LN 8¼ in for each drumstick tube cartridge. Multi rods 5, OD 3/16 in×LN 3⅝ in and 1, OD ⅛ in×LN 3⅝ in for each tube cartridge.
(Configuration 200*c* 201*c*) Multi rods 8, OD ⅛ in×8¼ in and 1, OD 3/16 in×LN 8¼ in for each drumstick tube cartridge 8, OD ⅛ in×LN 3⅝ in and 1, OD 3/16 in×LN 3⅝ in for each drumstick tube cartridge.

Procedure: Apply glue to the multi rods around the circumference of each rod, covering length of 4½ in from bottom. Next, apply glue to interior wall of OD 0.53125 in×ID 0.50325 in drumstick tube cartridge. Insert drumstick, multi rod (Configuration one, two, and three) combinations into drumstick tube cartridge. Crimp drumstick tube cartridges to drumstick to form fit, then slide heat shrink tube(drawings 106) OD ½ in LN 4 in to base of drumstick tube cartridge. Lastly, use a heat gun to shrink tube to bind the multi rods.

Step 7: Removable Shaker Tube Cartridges.

Materials:

OD 0.53125 in ID 0.50325 in 8 ft length brass tubing, carbon fiber tubing or aluminum tubing OD ⅝ in ID ⅝ in rubber or vinyl plugs 10-20, ⅛ in beads Procedure: Cut shaker tube cartridges to 4 different lengths: (configurations 300*a*,300*b*, 300*c*,300*d*) #1 LN 8 in×¼ in, #2 LN 3 in×⅝ in, #3 LN 7 in×¼ in, and #4 LN 2 in hollow tube body shaker tube cartridge. Next, use a miter saw, pipe cutter, or any saw capable of cutting carbon fiber or aluminum tubing, after making the cut, the tube will be de burred using sand paper, steel wool, or a reamer. Afterwards, insert 5/in8×in1 LN plugs into the bottom end of the shaker tube cartridges. LN 8 in×¼ in, LN 3 in×⅝ in, LN 7 in×¼ in, and LN 2 in. Next, place 10-20, ⅛ in beads into shaker tube cartridges LN 8 in×¼ in, LN 3 in×⅝ in, LN 7 in×¼ in, and LN 2 in. Then, insert 5×8 in×1 in LN plugs into the top of LN 8 in×¼ in, LN 3 in×⅝i, and LN 2 in shaker tube cartridges.

Hollow tube body shaker tube cartridge OD 0.53125 in ID 0.50325 in LN 2 in will be used for dispensing the beads held inside of it into the hollow tube body from step one. This will turn the hollow tube body into a shaker that will produce a louder sound and another dimension to this device.

Place OD ⅝ Hollow tube body cap over the bottom of OD 0.53125 ID 0.50325 LN 2 plug ID ⅝ of the shaker tube cartridge. Remove the plug on the top of 0.53125 in ID 0.50325 in shaker tube cartridge. Pour the metal beads held in the shaker tube cartridge into the hollow tube body from step 1 and slide the shaker tube cartridge into the hollow tube body.

Note: Any of these tube shaker cartridges can be taken out of this device and used independently for sole purpose of a shaker.

Step 8: Install hollow tube body end caps

Materials:

Rubber or vinyl ⅝ in OD×⅝ in length end cap.

Procedure: slide ⅝ in OD×⅝ in caps onto hollow tube body ends that are not being used.

Note: end caps may not be used if user is using both ends for playing

Step 9: Configuring the drum stick to play.

Procedure: Remove end cap from hollow tube body and slide any combination of drum sticks, multi rods shaker into the hollow tube body. Lock the drumstick tube cartridge into place by tightening down the set screw located in the set screw shaft collar. The hollow tube body and the drumstick tube cartridge should be flush at the ends of the hollow tube body. The set screw will align and press against the drumstick tube cartridge locking it into place. If using the drumstick tube cartridge on both ends, remove the cap from other end and slide the shaft screw collar into place and follow the same process. To reload the drumstick, loosen the set screw and slide the drumstick tube cartridges out of the hollow tube body.

Note: The specifications listed above can be duplicated to smaller and larger sizes using the same process. The drumstick tube cartridge can be attached to any type of drumstick for use of this devise.

I claim:

1. A telescoping drumstick that is an interchangeable, drumstick/shaker that is not confined to a hollow tube body; it includes a symmetrical hollow tube body with removable shaft screw collars on each end; it includes shaker tube cartridges that have a smaller circumference than the hollow tube's body inner circumference which allows it to telescope into the hollow tube body; it allows a user to combine the drumstick with a maraca like sound; it also includes another drumstick tube cartridge that is attached to a small tail end portion, directly around a different drumstick type, these also have a smaller circumference than the hollow tubes body inner circumference, which allows the drumstick tube cartridges to telescope into the hollow tubes body's inner circumference, the shaft screw collar locks and unlocks the hollow tube body and the tube cartridges together for dispensing, storage, and playing of this device; this allows the user to freely configure the drumstick to create multiple drumstick/shaker configurations.

2. A telescoping drumstick as recited in claim 1, where the hollow tube body acts as a storage space for other drumstick tube cartridges.

3. A telescoping drumstick as recited in claim 1, where the hollow tube body has the ability to store beads so that it can produce a maraca like, sound instead of storing drumstick tube cartridges.

4. A telescoping drumstick as recited in claim 1, where the hollow tube body has the same circumference at both ends.

5. A telescoping drumstick as recited in claim 1, where the tube cartridges have a smaller circumference than the hollow tube body's inner circumference.

6. A telescoping drumstick as recited in claim 1, where the smaller tube cartridge is attached to different drumstick types.

7. A telescoping drumstick as recited in claim 1, where the smaller tube cartridge telescopes into the hollow tube body.

8. A telescoping drumstick as recited in claim 1, where when the smaller tube cartridge is slid into the hollow tube body, a space in-between them is no more than 0.03125 in.

9. A telescoping drumstick as recited in claim 1, where the shaft screw collars are removable, mounted flush on said tube body symmetrical ends.

10. A telescoping drumstick as recited in claim 1, where the shaft screw collar locks and unlocks the hollow tube body and tube cartridge together.

11. A telescoping drumstick as recited in claim 1, where the drumstick tube cartridges can be attached to both ends of the hollow tube body via the shaft screw collar.

12. A telescoping drumstick as recited in claim 1, where a pilot hole drilled on said hollow tube body's symmetrical ends.

13. A telescoping drumstick as recited in claim 1, where the shaft screw collar is made of polycarbonate, carbon fiber or aluminum tubing.

14. A telescoping drumstick as recited in claim 1, where the hollow tube body is made from thin wall carbon fiber or aluminum tubing.

* * * * *